United States Patent [19]

Jaronen

[11] 4,303,825

[45] Dec. 1, 1981

[54] PORTABLE ELECTRIC HEATING DEVICE FOR THAWING MOTOR VEHICLE DOOR LOCKS

[76] Inventor: Niilo Jaronen, Lammasrinne 3 D 79, 01710 Vantaa 71, Finland

[21] Appl. No.: 57,349

[22] Filed: Jul. 13, 1979

Related U.S. Application Data

[62] Division of Ser. No. 951,834, Oct. 16, 1978, Pat. No. 4,247,753.

[30] Foreign Application Priority Data

Oct. 20, 1977 [FI] Finland ..... 773109
Nov. 21, 1977 [FI] Finland ..... 773509

[51] Int. Cl.[3] ..... E05B 17/00; H05B 3/40; F21V 33/00

[52] U.S. Cl. ..... 219/201; 70/431; 219/202; 219/221; 219/237; 219/240; 219/533

[58] Field of Search ..... 219/200, 201, 202, 221, 219/227, 229, 232, 233, 236, 237, 240, 533; 338/271; 70/431, DIG. 46

[56] References Cited

U.S. PATENT DOCUMENTS

| | | | |
|---|---|---|---|
| 2,146,854 | 2/1939 | Schleif | 219/234 |
| 2,371,534 | 3/1945 | McGrath | 219/221 X |
| 2,898,571 | 8/1959 | Moule et al. | 338/271 |
| 3,022,408 | 2/1962 | Wagner | 219/201 X |
| 3,379,854 | 4/1968 | Jovis | 219/202 X |
| 3,450,859 | 6/1969 | Brucker | 219/201 |
| 3,536,890 | 10/1970 | Hombrecher | 219/229 X |
| 3,973,422 | 8/1976 | Cervera | 219/201 X |
| 4,075,458 | 2/1978 | Moyer | 219/225 |

FOREIGN PATENT DOCUMENTS

| | | | |
|---|---|---|---|
| 1430621 | 12/1968 | Fed. Rep. of Germany | 219/202 |
| 2647805 | 4/1978 | Fed. Rep. of Germany | 219/202 |

*Primary Examiner*—A. Bartis
*Attorney, Agent, or Firm*—Abraham A. Saffitz

[57] ABSTRACT

A compact portable device energizable from a motor vehicle battery for thawing frozen motor vehicle door locks includes an electrically heated thawing stick sized for insertion into the keyhole of a frozen lock. The stick comprises a hollow metal body enclosing a resistance wire. One end of the wire is connected to the stip of the metal body and the other end is connected to an elongated cable terminating in a plug insertable into an electrical socket on the vehicle connected to the vehicle battery. The thawing stick is secured to a hollow protective case modeled in the form of a flat key end and provided with a key ring. The case has an open narrow side through which the cable can be inserted for storage within the case during non-use periods and the stick is pivoted for movement from a non-use position covering the open side of the case to an extended use position.

2 Claims, 10 Drawing Figures

Fig. 3
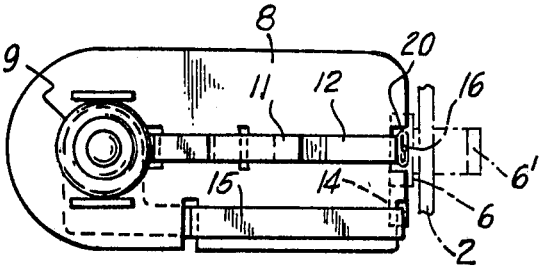
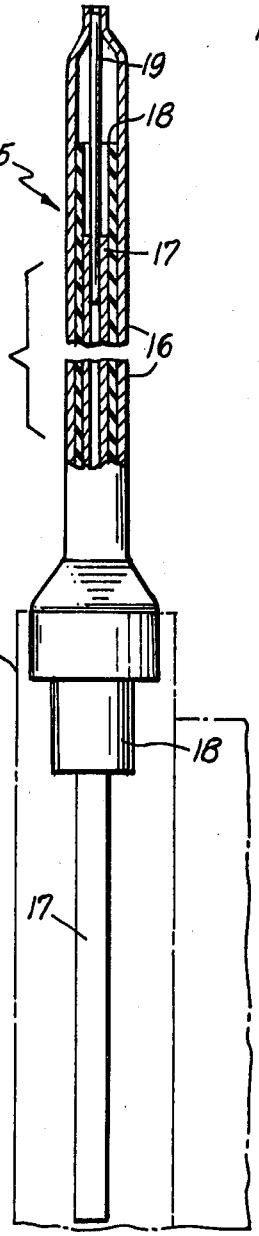
Fig. 4
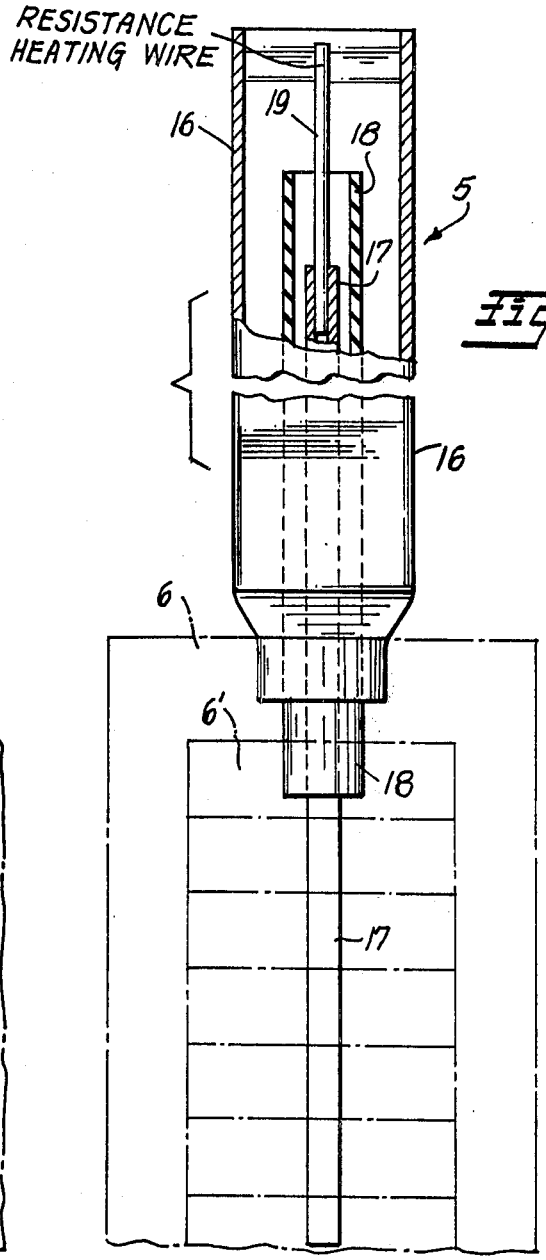
Fig. 5

PORTABLE ELECTRIC HEATING DEVICE FOR THAWING MOTOR VEHICLE DOOR LOCKS

This is a division of application Ser. No. 951,834, filed Oct. 16, 1978, now U.S. Pat. No. 4,247,753, granted Jan. 8, 1981.

BACKGROUND OF THE INVENTION

1. Field of the Invention

The present invention refers to a thawing means for frozen locks with an electrically heated thawing stick for insertion into the lock. The invention is specifically intended for thawing motor car locks in order to open or close them when moisture or water that has entered the lock has frozen so as to impede insertion of the key.

2. Description of the Prior Art

A number of different methods for opening frozen locks are known. At present, ice thawing and/or deicing agents sprayed into the lock through the key hole are most common. If the lock is badly frozen, thawing the lock with a deicing fluid takes time. Fluid also flows from the lock onto the car surface leaving an ugly trace. When the lock is so badly frozen that the cover plate in front of the key hole does not move away from the front, no fluid can enter the lock.

In addition, electrically heated keys, heating sticks as well as locks heated by electric resistance are known. Also previously known is a battery-operated heating plate which is pressed against the lock. Aforementioned designs known in prior art have been described, for instance, in the U.S. Pat. No. 3.022.408, in the German Patent Publication No. 1.553.309 and in the German Patent Application No. 2.123.161.

OBJECTS OF THE INVENTION

The object of this invention is to provide a small-sized lock thawing means that can be plugged into the car battery and is easy to use and wherein effective heating of the thawing stick is obtained. Current consumption in the battery-operated embodiment is low.

SUMMARY OF THE INVENTION

A battery operated portable thawing device for frozen locks is provided which has an electrically heated thawing stick sized for insertion into the key hole of a frozen lock associated with a car body and includes a cable insertable into a socket provided on the car body adjacent the lock so that when the cable is plugged into the socket the circuit is completed to the car battery associated with a car body. The thawing stick includes a resistance wire spaced about 10–15% of the length of the stick from the end of the stick insertable into the lock. The other end of the stick is attached to a hollow protective case having a ring adapted to hold a car door key or ignition key. The hollow case receives and stores the cable during periods of non-use. The thawing stick pivots into a storage recess in the case during non-use.

BRIEF DESCRIPTION OF THE DRAWINGS

In the following embodiments of the invention are described in detail by way of example only, with reference to the attached drawings, in which:

FIG. 3 is a plan view of the connecting plate showing the bulb and contact strips affixed thereto;

FIG. 4 is an enlarged and elevational view of the heating stick of the thawing device, partly in section, and with the slide actuator shown in phantom lines;

FIG. 5 is a front elevational view, partly in section, of the heating stick of FIG. 4;

and

Figure 9:
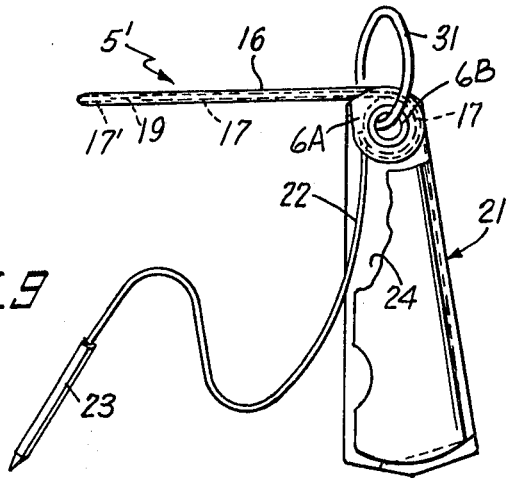
FIG. 9 is a side elevational view of another embodiment of the thawing device showing a carrying case for the thawing device.
Figure 10:
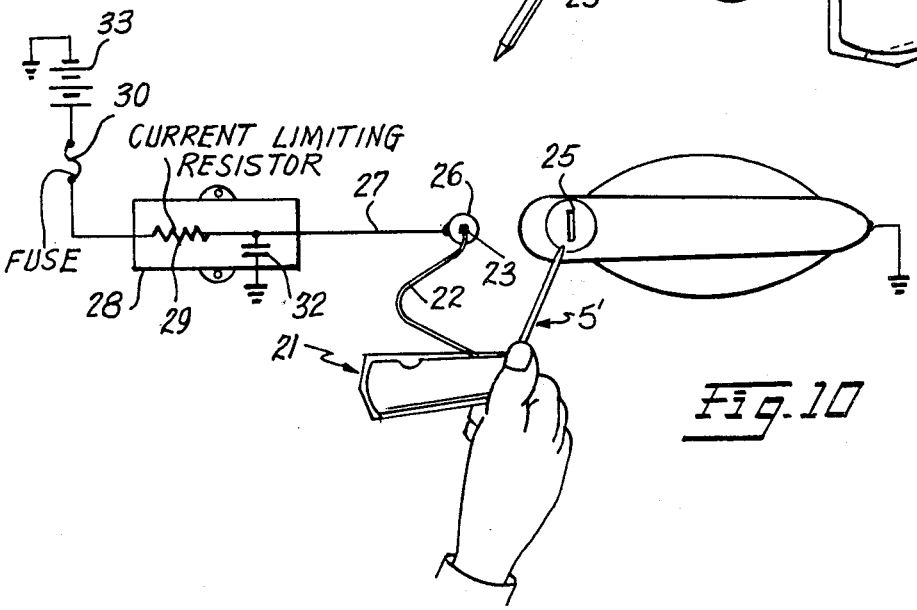

FIG. 10 is a diagrammatic illustration showing the embodiment of FIG. 9, together with a schematic wiring diagram for the thawing device.

DESCRIPTION OF THE PREFERRED EMBODIMENTS

Figure 1:
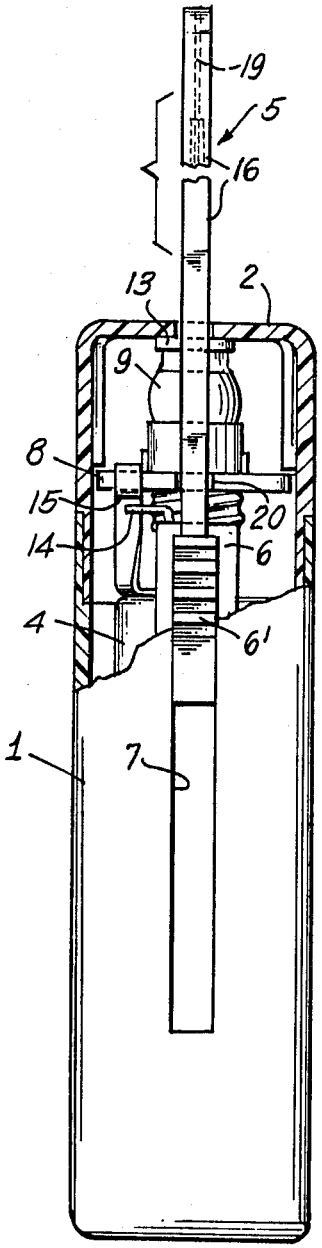
FIG. 1 is an end elevational view, partly in section, of the thawing device of the present invention.
Figure 2:
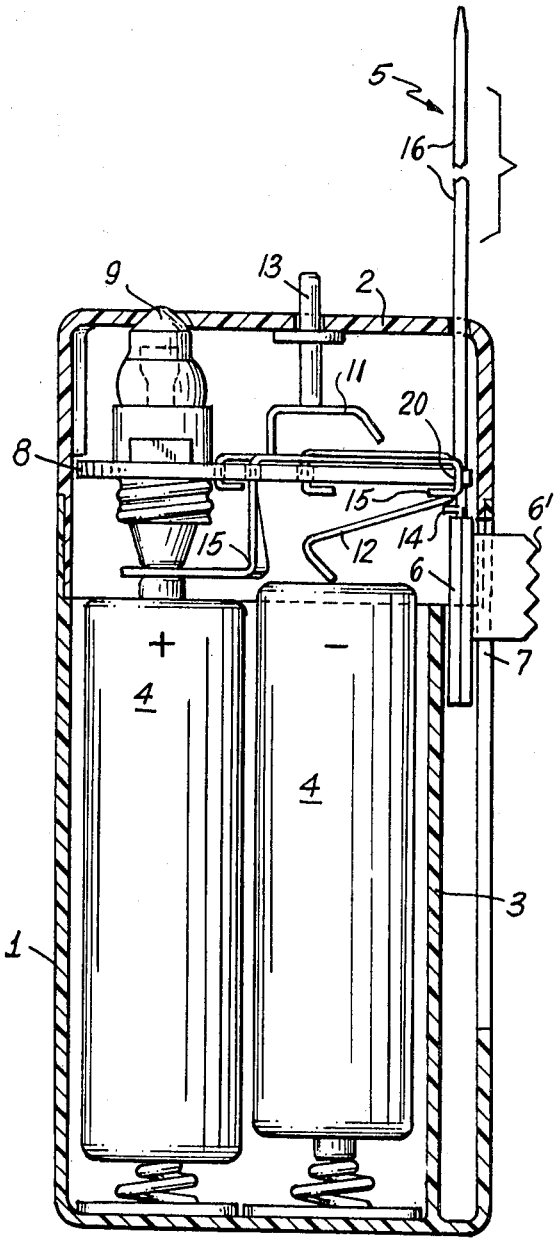
FIG. 2 is a vertical sectional view of the thawing device of FIG. 1.

The battery-operated embodiment will be described first with reference to FIGS. 1–3.

The protective housing of the thawing means consists of the body member 1 and the cover member 2 mountable on the open upper end of the body member. The body member 1 is divided by a partition 3 in two compartments, one compartment receiving the torch batteries 4 and the other compartment the displacing member 6 of the thawing stick 5. A knurled part 6' of the displacing member 6 comes out from a slotted opening 7 at the side of the housing 1. The thawing stick 5 can be pushed out of the housing and pulled back into the housing by means of displacing member 6, which slides along the partition 3 while being pressed against it. The cover member 2 receives a separate connecting plate 8 carrying a small incandescent bulb 9 below an opening 10 in the cover 2. The base of the bulb 9 is in permanent contact with the positive terminal of the left-hand battery 4, FIG. 2. The negative terminal of the right-hand battery 4, FIG. 2, is connected to the threaded part of bulb 9 by means of contact strips 11 and 12. The contact strip 11 urges by its own spring force the push-button switch 13 up. When the pushbutton switch 13 is pressed down, the end of contact strip 11 meets the contact strip 12, causing the circuit to bulb 9 to be closed. This switching arrangement is simple to manufacture but it serves well in the present case as a means of conserving the batteries. In addition to seeking the key hole to be thawed in the dark, bulb 9 can also be used for many other lighting purposes occurring when using a car.

The thawing stick 5 consists of a hollow flattened metal tube which is relatively thin as compared, for instance, with motor car keys. It therefore fits well into different kinds of locks. A resistance wire, which is heated by current from batteries 4, is placed within the hollow metal tube 5 in a way to be described in detail further on. The stick 5 itself serves with its outer surface as another contact surface, which slides in permanent contact along the contact strip 12. The connecting plate has a notch 20 (FIG. 3) for receiving the stick 5. The other contact point 14 for connecting current to the heating resistance running inside the stick 5 is secured to the upper edge of the displacing member 6 in such way that when the displacing member 6 is in its upper position and the stick 5 has been pushed out of the housing for use, then the contact point 14 meets the end of the contact strip 15. The other end of contact strip 15 is located between the base of the bulb 9 and the positive terminal of the left-hand battery shown in FIG. 2.

The design of the thawing stick 5 is described in the following with reference to FIGS. 4 and 5. Within the tubular metal case 16 which is of a size to fit into the keyhole of a lock, there is placed a tube 18 of insulating material encircling a thin metal tube 17. A thin resistance wire 19 is fixed within the upper end of the tube 17, the length of the wire being a relatively small part, in any case less than half and preferably less than one third of the total length of the stick 5. The upper end of the resistance wire 19 is fixed to the metal case 16 by flattening the case end and/or by soldering. The lower end of the stick 5 with its protruding metal tube 17 is placed within the displacing member 6 and the end of the tube 17 meets the contact point 17. Part of tube 16 engages terminal 12. In this way, a closed circuit is obtained via resistance wire 19 through parts 15, 14, 17, 19, 16 and 12. Also the tube 17 may be made of a suitable resistance wire that heats up at a certain current intensity, but the actual heating up takes place at a very thin resistance wire 19, e.g. of 0,12 mm thickness, connected in series with it. By this arrangement, a centralized heating effect is, on the one hand, achieved near the tip of the stick where heating is needed most to make it possible for the stick to penetrate the ice and, on the other hand, a very small current consumption is obtained as compared with an arrangement where the resistance causing the heating effect would have been accomplished by the length of the wire, when it has been accomplished in the invention by the thinness and shortness of the wire. Thus, it is possible to provide a compact, battery-operated, highly effective thawing means that can be carried in the pocket. The tubes 17 and 18 with resistance wire 19 are loosely placed within the socket tube 16 while it has a round cross section. Then the socket tube 16 is flattened in such way that it is pressed against the insulating material tube 18, whereby tubes 18 and 17 become permanently fixed within the socket tube 16.

In the foregoing description of FIGS. 1–5, there is described a specific embodiment of the invention claimed in U.S. Pat No. 4,247,753, granted Jan. 27, 1981.

Figure 6:
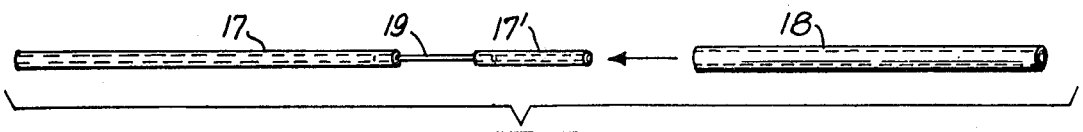
FIG. 6 is an enlarged exploded perspective view of the initial step of assembling a modified form of heating stick.
Figure 7:
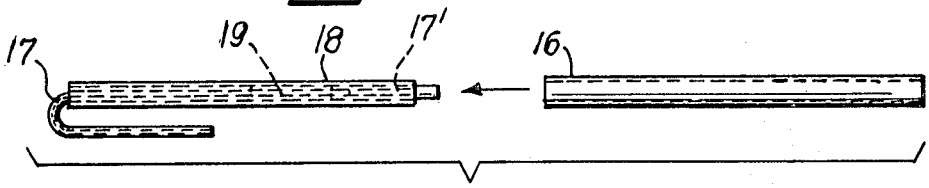
FIG. 7 is an exploded view of the next step in assembling the heating stick of FIG. 6.
Figure 8:
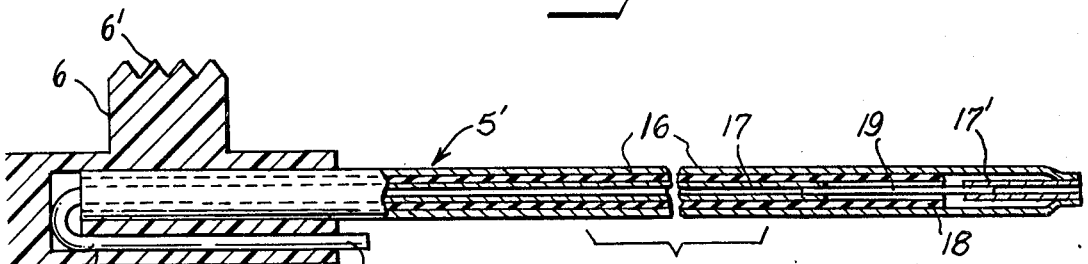
FIG. 8 is a further enlarged fragmentary sectional view, partly in elevation, of the final step in assembling the heating stick showing the slide attached thereto.

In order to prevent the resistance wire 19 from becoming involved in too strong fluctuations in temperature and in order to prevent contact disturbances in its juncture, a more advantageous construction of the thawing stick is presented at 5' in FIGS. 6 and 7.

Between the ends of two thin metal tubes 17 and 17' a thin resistance wire 19 is fixed by pushing the ends of the resistance wire a short distance within the tubes 17 and 17'. In the case of the present example, the length of the tube 17 is 53 mm and the length of 17' is 15 mm and the effective length of the wire 19 is 10 mm. By the effective length of resistance wire 19 is meant the glowing part of the resistance wire 19 between tubes 17 and 17'. An insulating material tube 18 of Kaflon, the heat resistance of which is about +350° C., is pushed over parts 17', 19 and 17 and the free end of tube 17 is bent whereby the construction shown in FIG. 7 is achieved. A protective metal case 16 is pushed over this assembly and the stick 5' formed in this way is flattened in a way that the parts are fastened to each other. A plastic sliding part 6, which functions as handle, is fastened to the end of stick 5'. The sliding part 6 is placed within the housing of the thawing means. Between the free end of the tube 17' and protective case 16 is formed an electricity conducting contact by flattening and/or by soldering. The bent end of tube 17 or the conductor fixed to it comes out of the sliding part 6 to form the other contact point 14.

FIGS. 9 and 10 present the adaptation of the thawing stick for use with a car battery. A major difference in the thawing stick 5' of the car battery operated device shown in FIGS. 9 and 10 is that the resistance wire can be three times thicker and its effective area slightly longer, however, less than 75% of the whole length of the stick. Also in this case the distance of the resistance wire from the tip of the stick should be 10–15% of the whole length of the stick 5'.

The end of the thawing stick 5' opposite the tip is fastened to a plastic piece 6A, inside which the free end of the conductor 17 is connected to an elongated cable 22, at the other end of which there is a connecting plug 23. Piece 6A is pivotably mounted to a protective case 21 by a ring shaped member 6B having a hole. The case is hollow and modeled in the form of a flat key end. Car keys can be hung up on the key ring 31 passing through the opening in member 6B and the member 6B acts as turning shaft for the part 6A. The case 21 has a hollow space 24 open at one narrow side. Through this open side the cable 22 can be pushed into the hollow space 24 of the case 21 during period of non-use and the stick 5' can be pivoted to rest within the edge of the case 21 in order to close the hollow space 24.

If the frozen lock cannot be opened with the key, the stick 5' is turned from inside the edge of the case 21 to the position shown in FIGS. 9 and 10 and the plug 23 is pushed in the socket 26, which has been provided close to the key hole 25. When the metal surface of the stick 5' touches the metal surface of the lock, the circuit between the battery 33 and stick 5' is completed and the resistance wire 19 inside the stick 5' becomes hot. The stick 5' can be pushed in the key hole 25 and when penetrating the hole it thaws the ice. The stick 5' is kept in the key hole for some time and after that the door can be opened with the key.

Socket 26 is connected to the car battery 33 by conductor 27. A fuse 30 is in circuit with conductor 27 and can be situated in the normal fuse box of the car. A box 28 houses a current limiting series resistance 29, and a parallel condenser 32 in circuit with cable 27 to prevent sparking between stick 5' and lock when the stick is withdrawn from the lock.

What I claim is:

1. A car battery-operated electrically heated thawing device for thawing frozen car locks including an elongated electrical cable, a connecting plug on one end of said cable insertable into a socket on the car adjacent to the frozen lock and connected to the car battery and a hollow protective case having an opening at the top receiving a ring which is adapted to hold a key for the car door and/or ignition of said car;

a thawing stick in the form of a thin, hollow, flattened, elongated, metal body having a height and width which is less than the thickness of the key fitting into the keyhole of the lock;

an electric resistance heating wire within the hollow inner wall portion of said metal body and extending from the center of said body toward one end thereof, said one end of said body defining the tip of said stick, the end of said wire being spaced from said one end of said body a distance between about 10–15% of the length of the stick and being electrically connected to said one end of said body by an electrically conductive member;

a conductor in said metal body connected to the other end of said wire and extending from the other end of said body for connecting said cable to said resistance wire, said resistance wire and conductor being electrically insulated from said metal body;

plastic fastening means at the top of said protective case pivotally connecting the other end of said metal body to said case, means within said plastic fastening means electrically connecting the other end of said cable to said conductor;

said protective case having a narrow side and a wide side, said narrow side being open for receiving said cable in the hollow interior of said protective casing for storage, said stick being pivotable into the open side of said housing to close said open side during non-use; and said stick being movable by manipulating said protective casing to make electrical contact between said metal body and the metal surface of said lock to complete the electrical circuit to the car battery through said conductive means, resistance wire, conductor and cable and to permit the resistance wire within the stick to become hot.

2. The combination of claim 1 including a current limiting series resistor and a parallel condenser in circuit with said cable to prevent sparking between said stick and said lock when the stick is withdrawn from the lock.

* * * * *